US006726225B1

(12) United States Patent
Stewart et al.

(10) Patent No.: US 6,726,225 B1
(45) Date of Patent: Apr. 27, 2004

(54) ANKLE SUPPORT FOR AN IN-LINE SKATE

(75) Inventors: Brian Stewart, Portland, OR (US); Christopher A. Robinette, Lake Oswego, OR (US); James Thorne, Portland, OR (US); Allen W. Van Noy, Weisendorf (DE)

(73) Assignee: Nike, Inc., Beaverton, OR (US)

( * ) Notice: Subject to any disclaimer, the term of this patent is extended or adjusted under 35 U.S.C. 154(b) by 2 days.

(21) Appl. No.: 10/003,691

(22) Filed: Nov. 14, 2001

(51) Int. Cl.[7] ..... A63C 17/06

(52) U.S. Cl. ..... 280/11.221; 280/11.224; 280/11.225

(58) Field of Search ..... 280/841, 11.19, 280/11.202, 11.214, 11.221, 11.224, 11.225, 11.217, 11.215, 11.211; 602/27, 28, 29, 65

(56) References Cited

U.S. PATENT DOCUMENTS

| | | | | |
|---|---|---|---|---|
| 2,444,428 A | | 8/1948 | Carrier | |
| 3,963,252 A | | 6/1976 | Carlson | |
| 4,835,885 A | * | 6/1989 | Hoshizaki et al. | 36/115 |
| 4,989,350 A | | 2/1991 | Bunch et al. | |
| 5,090,138 A | | 2/1992 | Borden | |
| D326,700 S | | 6/1992 | Brown et al. | |
| 5,125,171 A | | 6/1992 | Stewart | |
| 5,295,701 A | | 3/1994 | Reiber et al. | |
| 5,397,137 A | * | 3/1995 | Pellegrini et al. | 280/11.214 |
| 5,408,761 A | | 4/1995 | Gazzano | |
| 5,475,935 A | | 12/1995 | Frost | |
| 5,480,168 A | | 1/1996 | Chen | |
| 5,484,149 A | | 1/1996 | Lee | |
| 5,498,033 A | | 3/1996 | Hoshizaki et al. | |
| 5,505,470 A | | 4/1996 | Hoshizaki | |
| 5,526,586 A | | 6/1996 | Foscaro | |
| 5,992,872 A | * | 11/1999 | Proctor | 280/611 |
| 6,018,892 A | * | 2/2000 | Acheson et al. | 36/89 |
| 6,135,464 A | * | 10/2000 | Borel | 280/11.221 |
| 6,371,494 B1 | * | 4/2002 | Bonaventure et al. | 280/11.19 |
| 6,431,558 B1 | * | 8/2002 | Erdman | 280/11.19 |
| 6,517,090 B1 | * | 2/2003 | Fullum | 280/11.221 |
| 6,557,864 B1 | * | 5/2003 | Lenoir | 280/11.221 |
| 2001/0022434 A1 | * | 9/2001 | Sauter et al. | 280/11.221 |
| 2001/0028152 A1 | * | 10/2001 | Ricci | 280/11.221 |
| 2002/0171210 A1 | * | 11/2002 | Sauter et al. | 280/11.221 |

FOREIGN PATENT DOCUMENTS

| | | |
|---|---|---|
| DE | 30 04 668 A1 | 2/1980 |
| FR | 2 614 547 A1 | 4/1987 |
| GB | 584461 | 2/1947 |
| GB | 1 404 228 | 8/1975 |

OTHER PUBLICATIONS

MOJO "Sport & Soul" Brochure—Published 1996.

K2 Corporation Catalog—Published 1997.

ASOLO Advertisement—Publication date is unknown and Applicants submit that the publication date is at least one year prior to the Nov. 14, 2001 filing date of the present application.

ROLLERBLADE Specification—Publication date in unknown and Applicants submit that the publication date is at least one year prior to the Nov. 14, 2001 filing date of the present application.

* cited by examiner

*Primary Examiner*—Brian L. Johnson
*Assistant Examiner*—J. Allen Shriver
(74) *Attorney, Agent, or Firm*—Banner & Witcoff, Ltd.

(57) ABSTRACT

An ankle support, particularly for in-line skates, which includes a base support that wraps about the users heel and a spaced upper support which wraps about the user's leg. The upper and base supports are fixedly joined by a plurality of struts. At least one stop secured to either the upper support or the struts abuts a stop on the base support to provide a hard stop for maximum braking.

6 Claims, 4 Drawing Sheets

ANKLE SUPPORT FOR AN IN-LINE SKATE

FIELD OF THE INVENTION

The present invention relates to an ankle support particularly suited for in-line skates and the like which provides forward flexion, a rear hard stop, and lateral support.

BACKGROUND OF THE INVENTION

In-line skates typically include an upper and a rigid frame which encases the foot in an effort to provide a balance of comfort and stability. The frame is secured to an underlying roller chassis, which also may include a rear brake element.

Typically, frames have been formed of pivotally connected rigid parts which permit rotation of the leg about a transverse axis. These constructions, however, are constrained by the pivot pin and do not conform to the user's natural skating motion. Rotation of the parts about the pin also entails the generation of friction in the journal which results in inefficient movement. While monolithic frames are known, they tend to construct a user's movement, lack sufficient ventilation, or add undue weight. Further, hinged and monolithic frames fail to provide the necessary resistance for maximizing braking pressure.

SUMMARY OF THE INVENTION

It is an object of the invention to provide a stiff frame formed into a single integral piece, with no pivoting mechanism, which provides enhanced flexing, support, and ventilation.

It is another object of the invention to provide an ankle support which provides a natural longitudinal motion for the user's leg, while providing a hard rearward stop for maximum braking.

It is another object of the present invention to provide an in-line skate with a soft, shoe-like upper and a stiff frame in the heel and ankle area to provide support and comfort during skating.

It is a further object of the invention to make the soft upper, like a traditional running shoe, which provides a secure fit and comfort to the skater. The upper is provided with laces, straps, or other closure devices to secure the upper to the forefoot and instep area of the skater's foot.

The ankle support of the present invention includes a base support which wraps about the user's heel and a spaced upper support which wraps about the user's leg. The upper and base supports are fixedly joined by a plurality of struts. The struts permit a natural longitudinal flexing during use, while still providing lateral support. At least one stop secured to either the support or the struts abuts a stop on the base support to provide a hard stop for maximum braking.

DETAILED DESCRIPTION OF THE PREFERRED EMBODIMENTS

Figure 1:
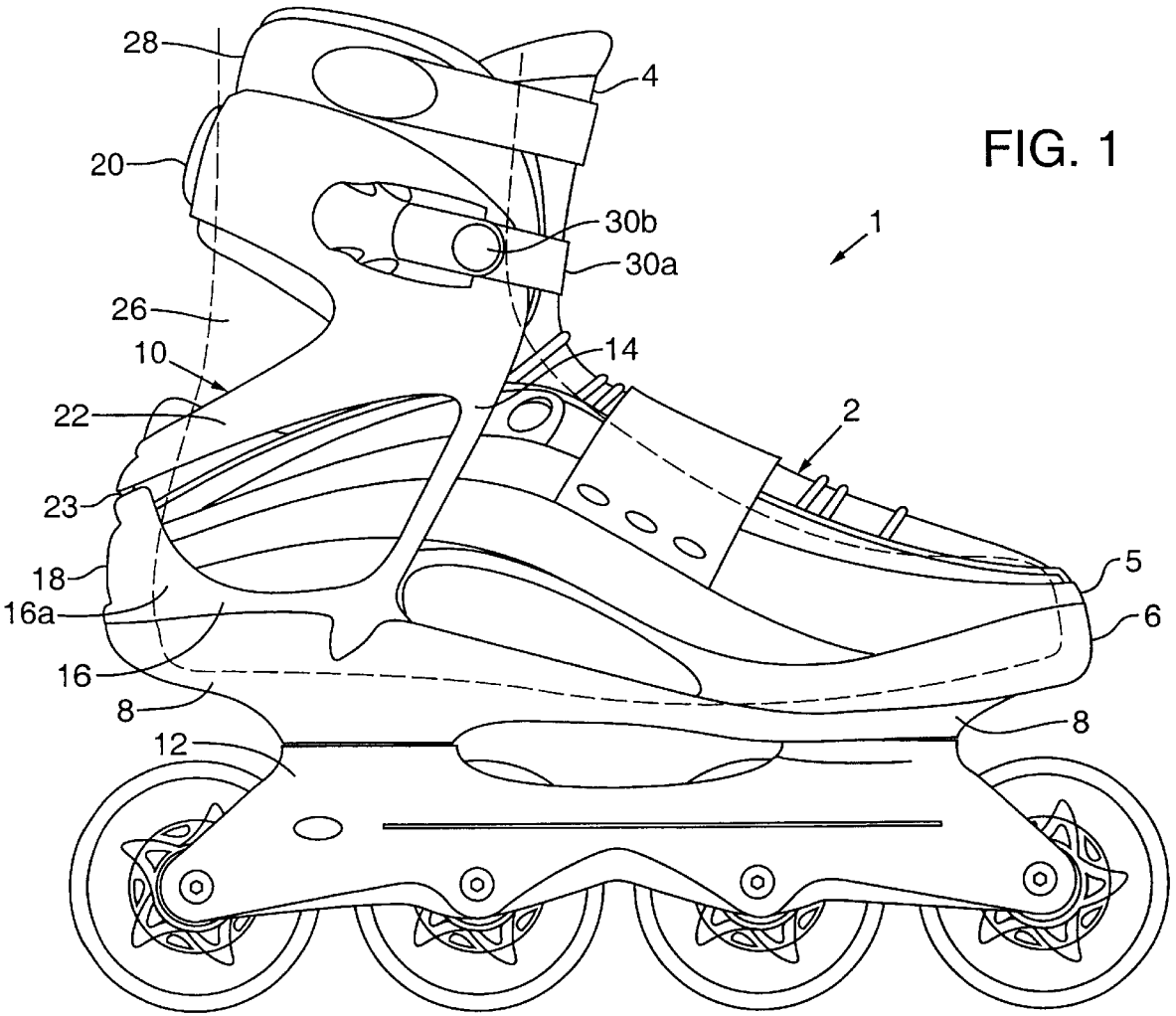
FIG. 1 is a side elevation of an in-line skate according to a first embodiment of the present invention.
Figure 2:
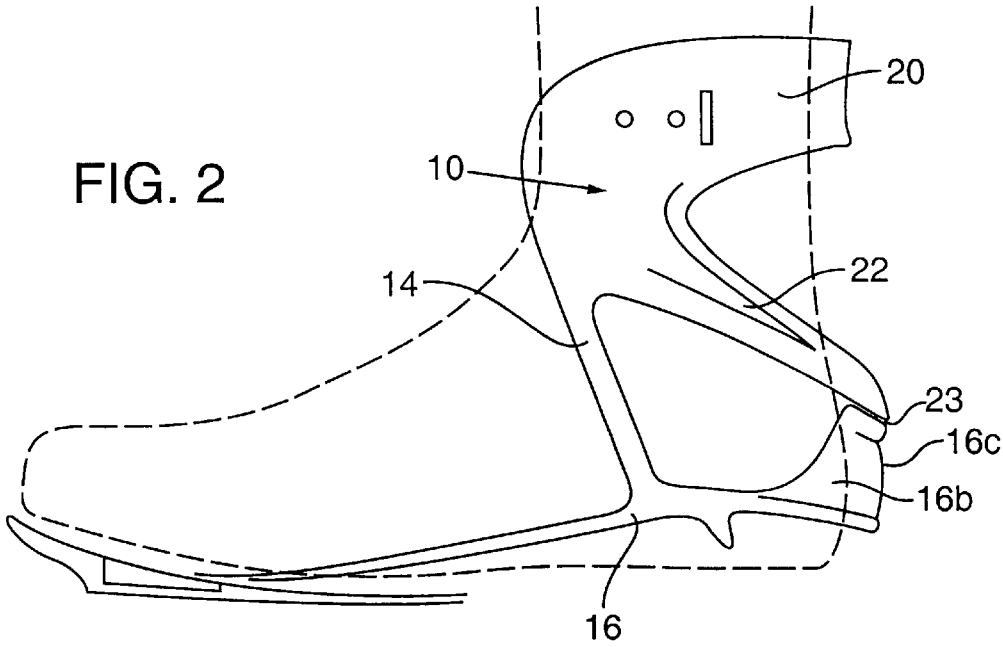
FIG. 2 is a side view of the frame of the skate shown in FIG. 1.

In-line skate 1 includes an internal shoe 2 forming a soft upper which encases the user's foot to provide suitable comfort in skating. The upper 2 is preferably formed like a soft running-shoe made from traditional materials, such as breathable mesh and synthetic suede. An inner lining (not shown) of the upper 2 may be composed of a polyester knit or similar material that is durable, transports perspiration away from the body, and dries quickly. The tongue 4 of the internal shoe 2 is also preferably made from traditional materials such as a combination of foam and heat embossed synthetic suede. Closure means, such as laces, straps, or buckles, are provided to secure the upper to the foot of the user. The toe area of the shoe may have a toe bumper 5 attached to it for protection against impact and abrasion. The bumper may be made from fiberglass filled plastic or similar material.

The internal shoe 2 is attached to a midsole 6 which is, in turn, secured to a rigid outsole plate 8 in the anterior portion of the foot. A frame 10 overlies the posterior part of the foot to provide the desired support. The frame 10 is also attached to the outsole plate 8 in the posterior part of the foot. The outsole plate is preferably made from an engineering plastic or similar material which is able to dampen vibration and protect against abrasion and impact. The outsole plate may contain an air cushion for shock absorption. An in-line skate chassis 12 is attached to the underside of the outsole plate 8.

Frame 10 is preferably made from a minimal amount of material so as to provide a lightweight and minimally sized support. The frame 10 is preferably formed as a single component of engineering plastic. Nevertheless, the frame could be fabricated from a plurality of components fixed together by rivets, adhesive or other fastening means. Moreover, alternative suitable materials could also be used.

The frame 10 includes a base support 16 which is rigidly secured to the outsole plate 8. Base support 16 has a concave, and preferably arcuate, configuration with an open front which wraps about the user's heel to define a medial side 16*a* and a lateral side 16*b* extending outward from the rear apex 16*c*. A web or upper support 20 also has a concave, and preferably arcuate, configuration which is open in the front and wraps around the back of the user's leg.

A pair of opposing vertical flexing struts 14 fixedly interconnect base support 16 and upper support 20 to form frame 10. The frame is preferably molded as a single piece, but as mentioned above, could have other constructions. The struts 14 are attached at their respective lower ends to the medial and lateral sides of base 16. In the preferred construction, one strut is provided on each side such that the struts are adjacent to the ankle bones (malleoli) of the user, and shaped and positioned such that they do not rub against the ankle bones. Nevertheless, a plurality of struts could be provided on either or both sides of the ankle. The struts may be reinforced with an internal rod made from known materials such as stainless steel. While the struts on the medial and lateral sides are preferably transversely aligned, they could be offset. For instance, the medial side strut could be offset rearwardly to better simulate the motion of the user's ankle. This arrangement could provide extra comfort by reducing chafing of the user's leg due to friction, and further reduce fatigue because the user does not encounter unnecessary lateral forces.

A pair of stop members 22 extend downward and rearward as elongated arms from the junction of the web or upper support 20 and the upper ends of struts 14. The stop members 22 terminate at the rear of the user's foot adjacent the achilles. These stops 22 contact a stop 23 formed along the top edge of base support 16. Stop 23 is preferably formed along the top edge of a raised rear portion 18 of base support 16, although other constructions could be used. Stop members 22 could alternatively be secured to either the upper support 20 or one or both struts 14. In addition, stops 22 could terminate at other locations to engage stop 23. Finally, although stops 22 are preferably formed as elongated arms, other structures could be used so long as they form a firm abutment at a rear predetermined position with stop 23 of base support 16.

The abutment of stops 22 against stop 23 provides a rear hard stop when the user is at the end of a skating stroke and his/her ankle becomes unflexed (in the upright position). This unflexed ankle position is also the position at which the struts are unflexed. The rear hard stop is provided to allow the user to effectively apply solid pressure to a brake mechanism (not shown) which may be attached at the rear of the skate.

Figure 4:
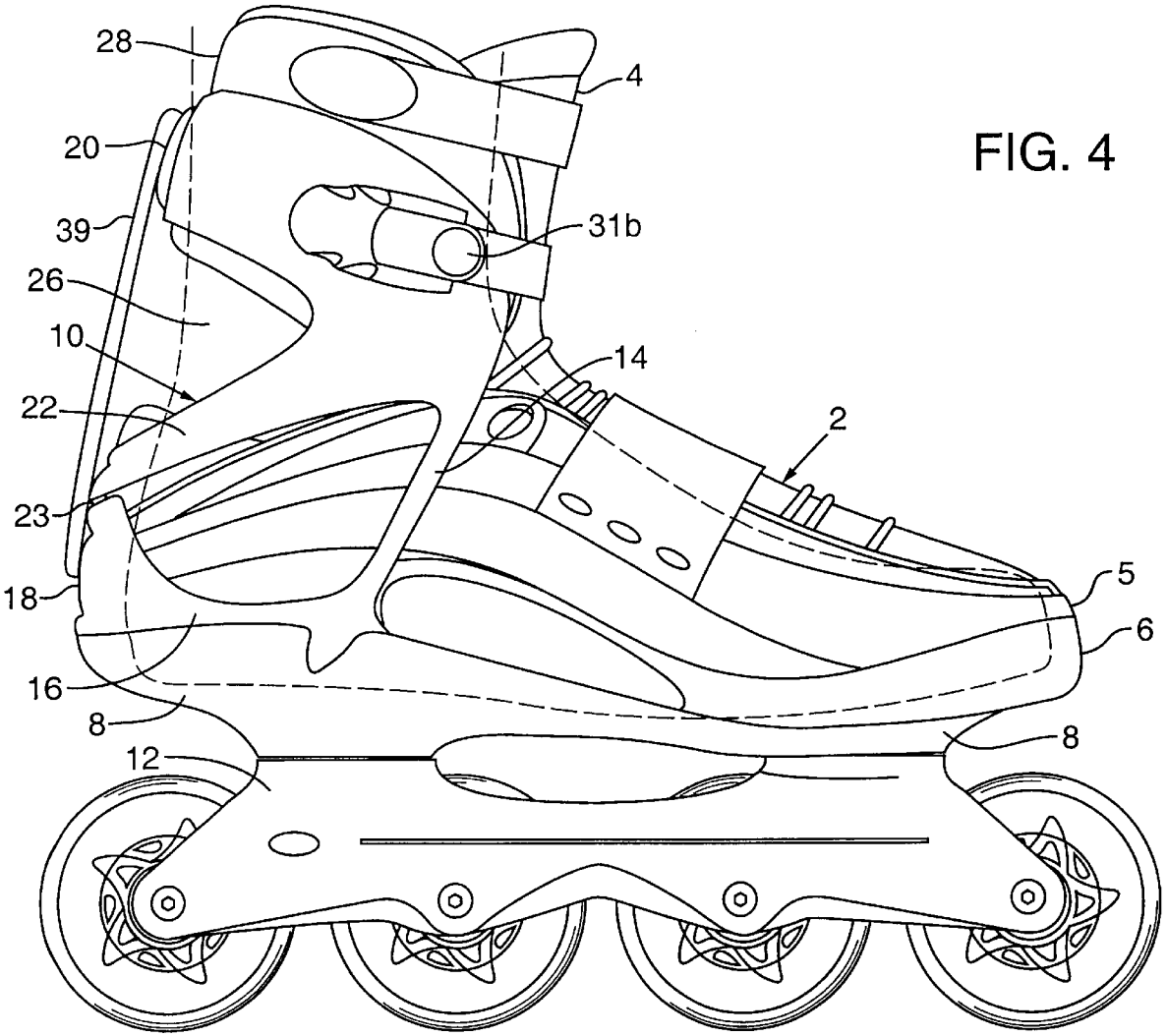
FIG. 4 is a side elevation view of an alternative embodiment provided with rear elastomeric flex member.

An opening 26, below upper support 20 and above the elongated arms forming stops 22, is provided to enhance ventilation. A pad 28 may be mounted to the inside of the upper support 20 to prevent the upper support from coming into direct contact with the back of the user's leg. A pad or cushion may also be provided along the entire interior of frame 10. At least one strap 30*a* with buckle 30*b* (or buckle 31*b*, as depicted in FIG. 4) or other closure is attached to the web 20 above the struts 14 to close the front portion of the web 20 and provide a secure fit to the lower leg above the ankle.

Due to the structural design of frame 10 and its material, the frame in the preferred embodiment is permitted to flex forward to a maximum of about 45 degrees beyond the unflexed position as the skater bends at the ankle. Stiff lateral support, however, is not compromised by this flex in the forward (longitudinal) direction. Because this member is flexing rather than pivoting, it stores the energy generated during the skater's stroke due to ankle flexion, and returns the energy to the skater as the ankle straightens at the end of the staking stroke. Moreover, the flexing, as opposed to pivoting, allows the upper support 20 to move in conformance with the natural skating motion of the leg.

Figure 3:
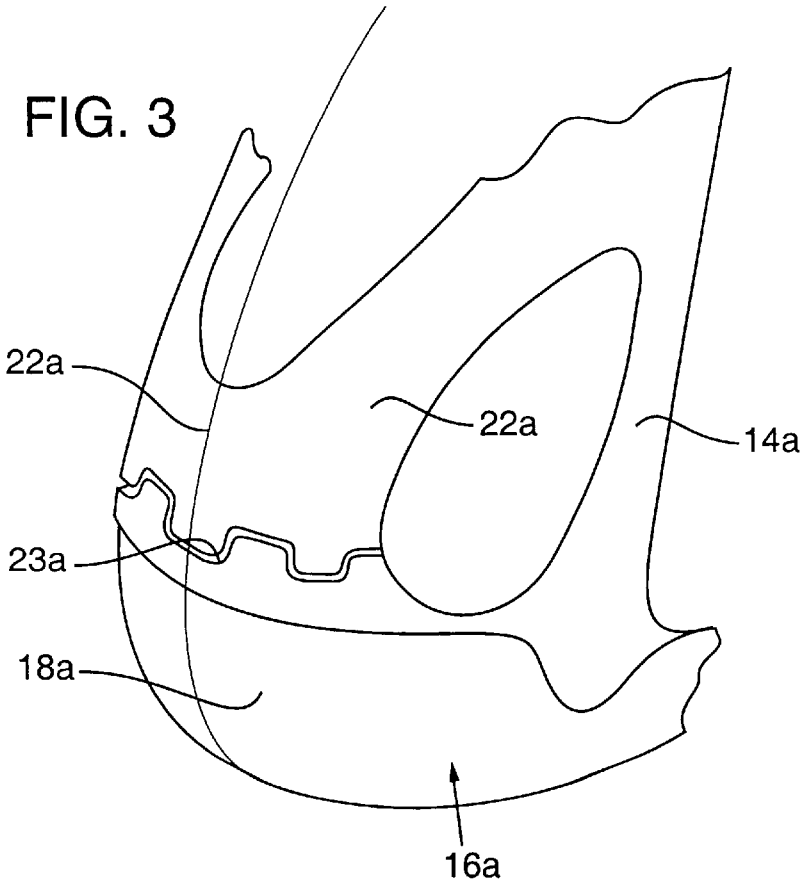
FIG. 3 is a partial perspective view of a frame with an alternative stop construction.

In an alternative embodiment, shown in FIG. 3, the stop 23*a* of the raised portion 18*a* of base support 16*a* has an undulating configuration which mates with a corresponding undulating structure at the ends of the stop members 22*a*. In this way, relative movement of the stop members 22*a* is restricted in the lateral direction as well as the downward direction. While the mating undulations are preferably rectangular in shape, other mating surfaces limiting downward and lateral movement of stops 22*a* could be used. Further, while stop members 22*a* in this alternative are secured to struts 14*a*, they could also be secured to the upper support (not shown).

In another embodiment (FIG. 4), an elastic member 39 is attached to the rear of the upper support 20 and to the raised portion 18 of base support 16. For convenience the same numbers used in the first embodiment have been used for like parts. The elastic member 39 biases upper support in a rearward direction toward base support 16, and provides additional energy storage to supplement the flexing of struts 14.

Figures 5, 6:
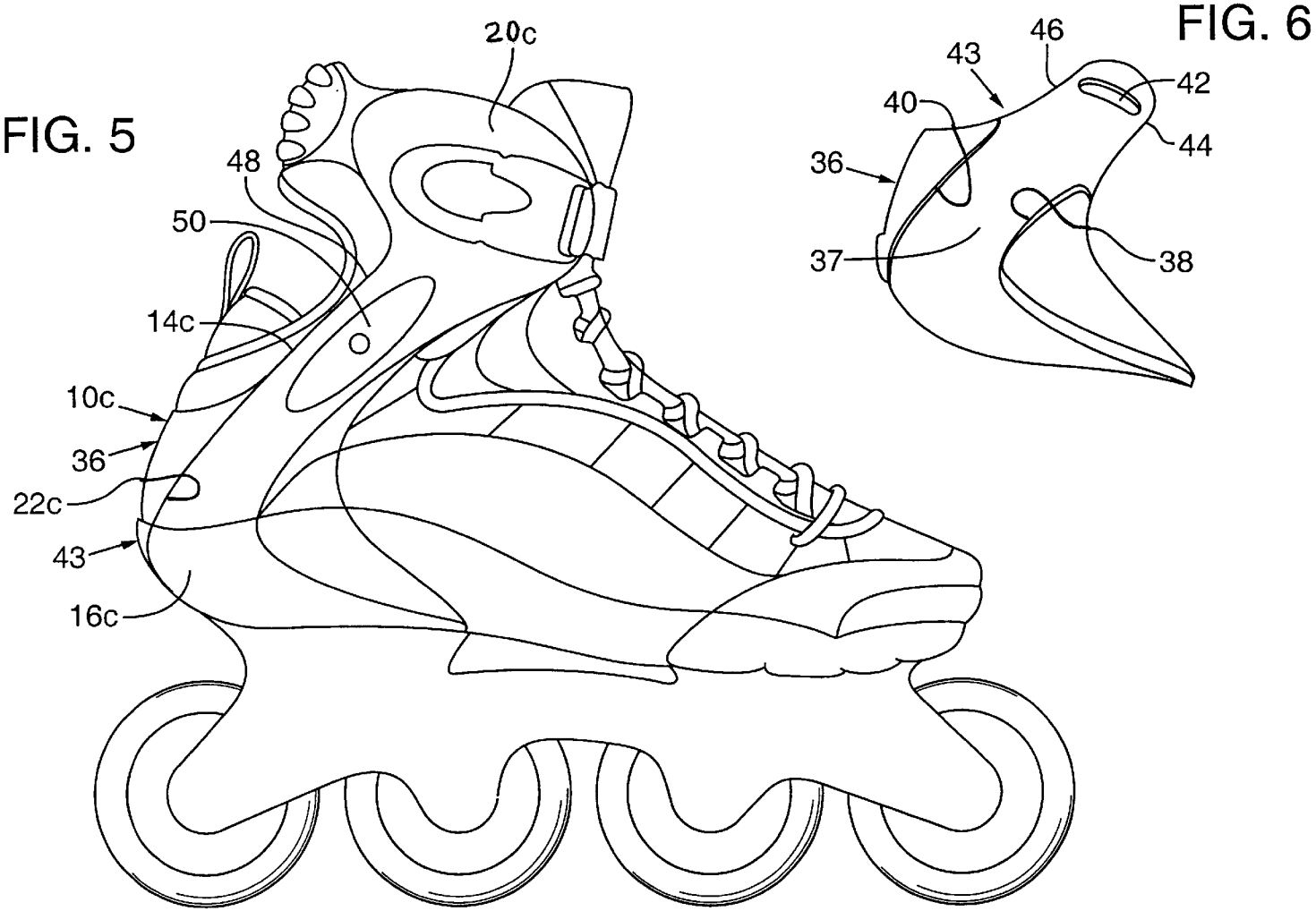
FIG. 5 is a side elevation view of an alternative embodiment provided with a flex limiting/stiffening mechanism.
FIG. 6 is a profile view of the flex limiting/stiffening mechanism shown in FIG. 5.

In another embodiment (FIGS. 5 and 6), a flex limiting and stiffening mechanism 36 is incorporated into the frame 10*c* on either or both sides of the ankle. This mechanism includes a body 43 that is fixed to and forms a part of base support 16*c*. Body 43 has a channel 37 formed with a leading edge 38 and rearward edge 40. The strut 14*c* is situated in the channel 37 so as to flex between the leading edge 38 and the rearward edge 40. Edges 30 and 40 limit the forward and rearward motion of the upper support 20*c*. The rear edge of the strut 14*c* received in channel 37 forms a stop 22*c* which abuts the stop defined by the rearward edge 40 to form a hard stop to maximize braking.

In addition, a limiting slot 42 is provided along an upper portion of body 43. The limiting slot 42 has a forward end 44 and a rearward end 46. An adjustable flex cam 48 is situated on the outside of the strut 14*c* and is rotatable relative to the strut about a pin of an inside cam member 50. The inside cam member 50 is slidable within the slot 42 and extends in an expanded form along the inside of the frame. This adjustable flex cam 48 is rotatable about cam 50 out of channel 37 so as to pull cam 50 against the back of the flex limiting member 36 and apply an adjustable resisting friction force on the sides of the slot 42 to thereby stiffen the flex characteristics of frame 10*c*.

Although the description above contains many specificities, these should not be construed as limiting the scope of the invention but merely providing illustrations of the invention, it will be appreciated that many modifications and changes may be made by those skilled in the art without departing from the spirit of the invention. For example, the stiff support structure could be used in combination with a cross-country ski boot, hiking boot, snowboard boot, and the like where stiff lateral support is desired with forward flex. Also, the stiff support structure and the base plate could be formed into one monolithic piece from a single mold rather than separate attachable pieces, or even the support structure, base plate, and chassis together could be formed from a single mold.

Thus, the scope of the invention should be determined by the appended claims and their legal equivalents, rather than by the example(s) given.

What is claimed is:

1. An ankle support comprising:

a base support having a generally concave configuration which is adapted to wrap about a user's heel and define a medial side and a lateral side extending from a rear apex, said base support further including a first stop;

an upper support having a generally concave configuration which is adapted to wrap about the user's leg, said upper support being spaced from said base support;

a plurality of struts fixedly connected to said upper support and said base support such that at least one strut extends upward from each of said medial and lateral sides of said base support, said struts being flexible to permit longitudinal movement and resist lateral movement of said upper support relative to said base support; and a second stop connected to one of said struts or said upper support, said second stop abutting said first stop at a predetermined position to form a hard rear stop and thereby prevent any rearward movement of said upper support relative to said base support beyond said predetermined position, said first and second stops include complementary undulating abutting edges which limit lateral movement between the first and second stops when abutted at said predetermined position.

2. An ankle support in accordance with claim 1 in which said second stop includes at least one arm extending rearwardly and downwardly from one of said struts or said upper support.

3. An ankle support in accordance with claim 1 in which said first stop is formed along a top edge of said base support.

4. An ankle support in accordance with claim 1 in which said base support and said upper support are open in the front.

5. An ankle support in accordance with claim 1 further including a closure to selectively tighten said upper support about the user's leg.

6. An ankle support in accordance with claim 1 which said upper support is spaced from said base support to define an opening over said rear apex of said base support.

* * * * *